US009074307B2

(12) United States Patent
Yamamoto et al.

(10) Patent No.: US 9,074,307 B2
(45) Date of Patent: Jul. 7, 2015

(54) LOOM AND WEAVING METHOD USING THE SAME

(75) Inventors: Nobuyuki Yamamoto, Aichi (JP); Masashi Shimahara, Aichi (JP); Masaru Ide, Aichi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 14/122,840

(22) PCT Filed: May 22, 2012

(86) PCT No.: PCT/JP2012/063080

§ 371 (c)(1),
(2), (4) Date: Nov. 27, 2013

(87) PCT Pub. No.: WO2012/165231

PCT Pub. Date: Dec. 6, 2012

(65) Prior Publication Data

US 2014/0110016 A1 Apr. 24, 2014

(30) Foreign Application Priority Data

May 27, 2011 (JP) ..... 2011-118685

(51) Int. Cl.

| | |
|---|---|
| ***D03D 49/46*** | (2006.01) |
| ***D03D 47/18*** | (2006.01) |
| ***D03J 5/02*** | (2006.01) |
| *D03D 41/00* | (2006.01) |

(52) U.S. Cl.

CPC ..... *D03D 47/18* (2013.01); *D03D 49/46* (2013.01); *D03J 5/02* (2013.01); *D10B 2101/12* (2013.01)

(58) Field of Classification Search

CPC . D03D 49/46; D03D 15/06; D03D 2700/828; D03D 2700/83; D03D 41/00; D03D 49/24; D03D 49/68; D03D 5/00; D03D 47/02; D01D 10/0436; D03C 13/00; D04H 3/04

USPC ..... 139/141, 134, 191, 199, 440, 449, 456; 28/101, 102, 171

See application file for complete search history.

(56) References Cited

U.S. PATENT DOCUMENTS 1,490,749 A * 4/1924 Lambert et al. ..... 139/141
2,696,840 A * 12/1954 Berkowitz ..... 139/134

(Continued)

FOREIGN PATENT DOCUMENTS

CH 117 330 A 11/1926
DE 39 32 184 C1 1/1991

(Continued)

OTHER PUBLICATIONS

The Extended European Search Report issued Sep. 24, 2014, in Application No. / Patent No. 12792068.4-1710 / 2716803.

(Continued)

*Primary Examiner* — Bobby Muromoto, Jr.
(74) *Attorney, Agent, or Firm* — Oblon, McClelland, Maier & Neustadt, L.L.P.

(57) ABSTRACT

A loom, containing a first and second fill yarn-holding conveyor rods which are disposed at left and right sides of an opening formed by multiple side-by-side warp yarns that run in one direction at a prescribed speed and are repeatedly inserted into the opening toward center of a weaving width and withdrawn, a single fill yarn conveyor selectively gripped by the ends of the first or second fill yarn-holding conveyor rod, a first and second rod operating units which cause the first and the second fill yarn-holding conveyor rods to be inserted into the opening in a synchronized state and to be withdrawn from the opening, and a first and second fill yarn conveyor gripping and releasing units which are fixed to opposite ends of the first and the second fill yarn-holding conveyor rods and alternately repeat operations of gripping, releasing, and delivering the fill yarn conveyor.

10 Claims, 4 Drawing Sheets

(56) References Cited

U.S. PATENT DOCUMENTS

| | | | | |
|---|---|---|---|---|
| 3,144,885 | A * | 8/1964 | Boyes et al. | 139/141 |
| 3,313,323 | A * | 4/1967 | Calemard | 139/291 C |
| 4,173,990 | A * | 11/1979 | Langlois et al. | 139/440 |
| 4,497,098 | A * | 2/1985 | Lay et al. | 28/171 |
| 4,793,158 | A * | 12/1988 | Liebrandt | 66/84 A |
| 5,111,672 | A * | 5/1992 | Gille et al. | 66/84 A |
| 5,908,290 | A * | 6/1999 | Kawamura et al. | 432/59 |
| 6,176,104 | B1 * | 1/2001 | Zorini et al. | 66/1 R |
| 8,131,395 | B2 * | 3/2012 | Johnson et al. | 700/130 |

FOREIGN PATENT DOCUMENTS

| | | |
|---|---|---|
| EP | 1 749 913 A1 | 2/2007 |
| GB | 154 616 | 4/1921 |
| JP | 38 24782 | 11/1963 |
| JP | 48 21177 | 6/1973 |
| JP | 48 29825 | 9/1973 |
| JP | 49 72464 | 7/1974 |
| JP | 51 75150 | 6/1976 |
| JP | 61 11780 | 1/1986 |
| JP | 61 63718 | 4/1986 |
| JP | 10 266024 | 10/1998 |
| JP | 2011 12363 | 1/2011 |

OTHER PUBLICATIONS

International Search Report Issued Aug. 14, 2012 in PCT/JP12/063080 Filed May 22, 2012.

* cited by examiner

FIG. 5A
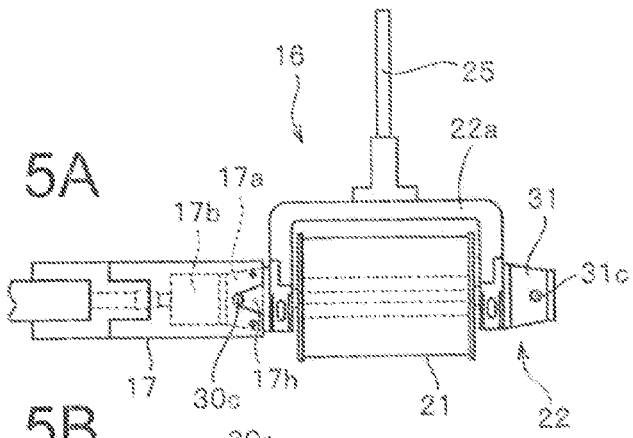
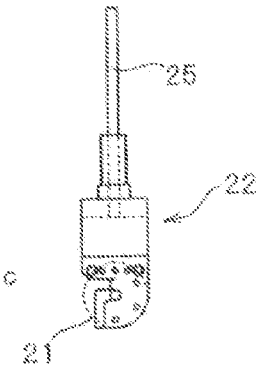
FIG. 5C
FIG. 5B
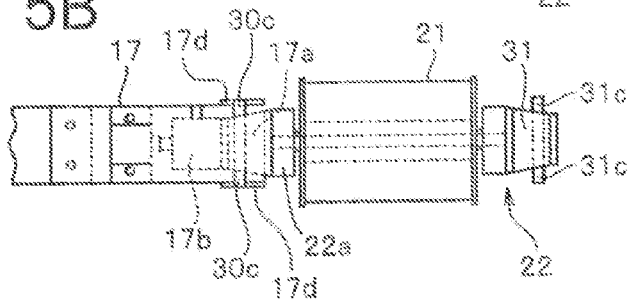
FIG. 6
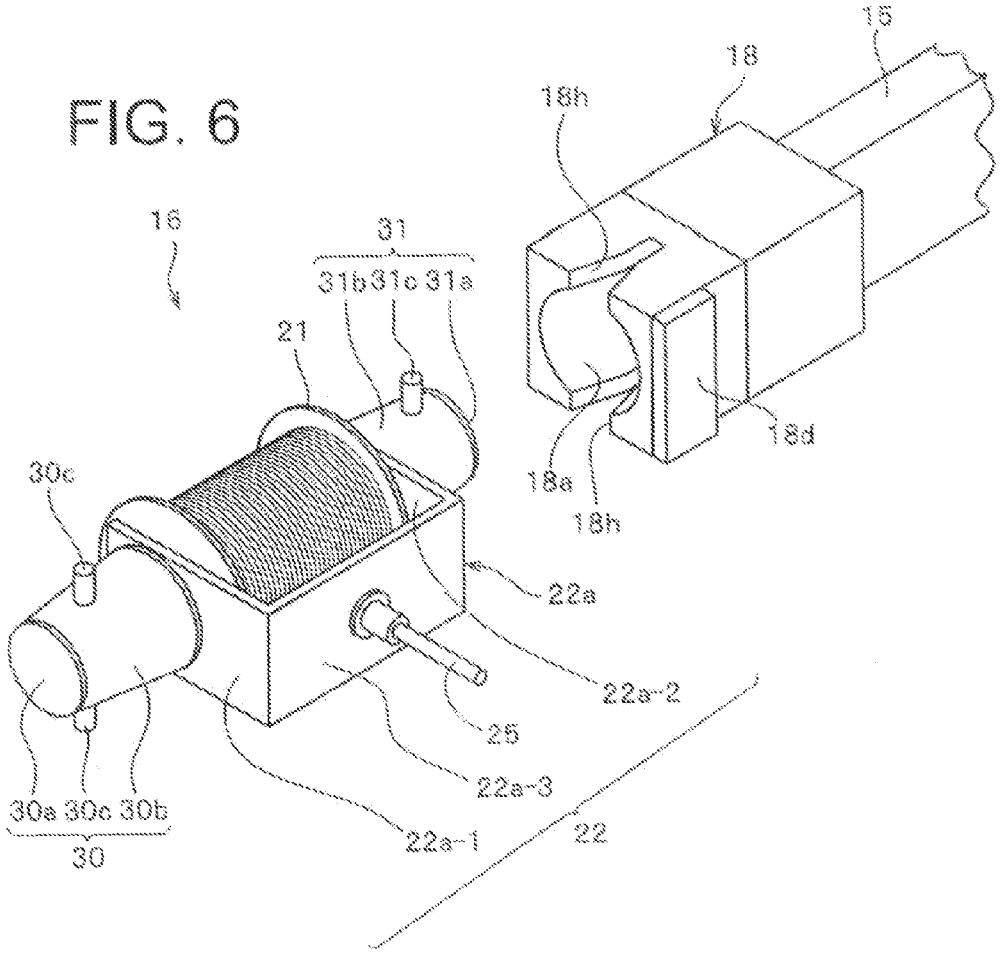

LOOM AND WEAVING METHOD USING THE SAME

TECHNICAL FIELD

The present invention relates to a loom similar to a gripping rapier loom and a weaving method using the loom, and particularly, to a special loom best suitable for weaving a precursor fiber fabric corresponding to the production of a carbon fiber and a fabric weaving method using the special loom.

BACKGROUND ART

A loom is used to produce a fabric obtained by mixing plural warp yarns and fill yarns. The loom is largely classified into a shuttle loom and a shuttle-less loom.

In the weaving using the shuttle loom, plural warp yarns aligned in one direction through a mail of a heddle are guided so that a part of the warp yarns are moved up and a part of the warp yarns are moved down so as to form a rhombic opening between the warp yarns in a manner such that the heddle is moved up and down based on the weave texture. While the opening is formed, a shuttle for accommodating and holding a fill yarn bobbin is beaten into a shuttle path formed inside the opening. The fill yarn is drawn out from the bobbin accommodated inside the shuttle by the beating. When the beating ends, a dent which is disposed between the heddle and the cloth fell position swings toward the cloth fell position, so that the fill yarn is pressed into the cloth fell position. The weaving is performed by repeating these operations.

The weaving using the shuttle-less loom is different from the weaving using the shuttle loom in that the above-described shuttle is not used and the fill yarn directly passes through the opening formed by the warp yarns. The shuttle-less loom may be classified into plural types in accordance with a difference in the method of inserting the fill yarn into the opening. As one of representative looms, there is known a water jetting loom which loads a fill yarn on a water jetting stream so that the fill yarn is inserted into a shuttle opening. As the other looms, there is known a needle loom in which a fill yarn is gripped by a front end of a needle moving in a reciprocating manner inside an opening of warp yarns, the needle is moved in a reciprocating manner inside the same opening, and loops of the adjacent folded-back portions are sequentially connected and matched by a knitting needle so as to obtain a fabric or a rapier loom in which a rapier formed as a stab member is disposed at the left and right sides of the loom and a front end of a fill yarn is moved in a reciprocating manner to the inside or the outside of the opening by the entire weaving width or a half of the weaving width while the front end thereof is gripped or released by a carrier head of each front end of the left and right rapiers so that the fill yarn is directly inserted into the opening.

These conventional looms respectively have good and bad points.

For example, in the shuttle loom, the fill yarn is reliably inserted, but the amount of the fill yarn accommodated and held by the shuttle is limited. Further, since the fill yarn is inserted while the shuttle flies along the shuttle path through the beating of the shuttle, the weight of the entire shuttle including the fill yarn is also limited. Accordingly, the mechanical beating sound generated by the fill yarn inserting operation is large, and hence a noticeable noise is generated. In one shuttle-less loom, noise may be solved by reducing the mechanical sound. However, for example, in the general shuttle-less loom, the operation of controlling the fill yarn length and the fill yarn end process at the ear portion of the edge of the weaving width is complex. Further, in the water jetting loom, various techniques of ensuring the straight traveling of the water are needed, and the adverse influence caused by the use of the water needs to be handled in various respects. Further, in the gripping rapier loom, mistakes may be caused during the operation of delivering the front end of the fill yarn by the carrier head or cutting the yarn end.

For example, when producing a carbon fiber under such circumstances, various precursor fibers are bound as one fiber bundle, and plural fiber bundles are disposed in parallel as a sheet. The fiber bundles are introduced into a flame-resistant furnace in the atmosphere of oxidization so as to be subjected to a flame-resistant process at 200 to 300° C. and are subsequently carbonized in a sintering furnace at 500 to 1500° C. in the atmosphere of nitrogen. The sintering speed at this time is generally 5 to 10 m/minute. Meanwhile, there is a recent demand for the improvement of the productivity, and hence the sintering speed and the total fiber fineness of the fiber bundle tend to increase. As the precursor fiber, acrylonitrile-based fibers are used in many cases.

As described above, when the flame-resistant process is continuously performed on various thick fiber bundles while running and being disposed in parallel in a sheet state, the maximal thickness of one fiber bundle increases, so that oxygen does not widely spread into the fiber bundles and the yarn is easily damaged due to the accumulation of heat. In order to prevent this problem, the flame-resistant process needs to be performed for a long period of time by decreasing the temperature of the flame-resistant process. However, since there is a difference in progress of the flame-resistant process between the inside and the surface of the fiber bundle, a nap may be raised or a yarn is damaged in the subsequent carbonizing process. For this reason, it is difficult to obtain the high-quality carbon fiber.

In order to continuously produce the carbon fiber, a method is proposed in which a carbonizable fiber filament bundle having thick fiber fineness is flattened as described above, the fiber filament bundle is disposed in parallel so as to become a band-like material, and the band-like material is sintered at a high temperature. However, in a case where a material obtained just by disposing the fiber bundle in a band shape is sintered at a high temperature, the nap of the single fiber forming the band-like material in the flame-resistant process or the ends of the damaged yarns is particularly wound on a roller inside a furnace or is tangled with the adjacent fiber bundles inside the furnace, and hence the more naps occur or the more yarns are damaged. As a result, the continuous sintering process needs to be stopped without any choice.

In order to solve these problems, for example, JP 10-266024 A (Patent Literature 1) proposes a method in which the precursor fiber bundle is guided inside the flame-resistant furnace in a zigzag shape by a rectangular guide groove to multi-stage guide rolls provided at the inlet and the outlet of the flame-resistant furnace and the precursor fiber bundle guided inside the flame-resistant furnace is maintained, through the guide groove, in a state where the cross-sectional shape thereof becomes a substantially rectangular shape in which the oblateness defined by the transverse width and the yarn thickness of the fiber bundle is 10 to 50.

Further, in order to exclude the above-described problems, for example, JP 51-75150 A (Patent Literature 2), JP 61-63718 A (Patent Literature 3), and U.S. Pat. No. 4,173,990 (Patent Literature 4) proposes a method in which various precursor fiber bundles formed in a sheet shape are formed by warp yarns and are mixed with fill yarns so as to form a fabric by weaving. Here, in Patent Literatures 2 and 3, one fill yarn is folded back toward the end of the entire weaving width so as to be mixed with the warp yarn. However, in Patent Literature 4, the rapier formed as a pair of double tubes is disposed at the left and right side of the loom in the width direction, the fill yarns are respectively inserted through the inner tubes of the left and right rapiers, the front ends of the respective fill yarns are gripped and conveyed by using the air pressure transferred to the outer tube of the rapier, and the respective fill yarns are folded back to the center portion inside the opening formed by the warp yarns. Here, the weaving is performed by alternately repeating the operations of inserting and separating the left and right rapiers into and from the opening with a predetermined time interval therebetween.

Meanwhile, in Patent Literatures 2 and 3, for example the flame-resistant process is performed on the precursor fiber bundles as the adjacent warp yarns to be introduced into the flame-resistant furnace for the process thereof while the fill yarns are inserted thereinto and the precursor fiber bundles are separated by the fill yarns so as to prevent the contacting or the lapping thereof. Then, in Patent Literatures 2 and 3, the fill yarn is automatically removed from the fabric after the flame-resistant process, and various fiber bundles subjected to the flame-resistant process are introduced into the carbonizing furnace while being simply aligned.

CITATION LIST

Patent Literature

Patent Literature 1: JP 10-266024 A
Patent Literature 2: JP 51-75150 A
Patent Literature 3: JP 61-63718 A
Patent Literature 4: U.S. Pat. No. 4,173,990

DISCLOSURE OF INVENTION

Problem to be Solved by the Invention

Incidentally, the production speed of the conventional acrylonitrile-based fiber tow fabric is extremely slow so as to be 150 cm/minute as described in, for example, Patent Literature 3, and the recent production speed thereof becomes 400 cm/minute at maximum due to an increase in speed with the development of the technology. For this reason, a thick acrylonitrile-based tow of 30000 d or more as the precursor fiber bundle is used in the warp yarn in order to improve the productivity of the carbon fiber. Then, in order to obtain the high-quality carbon fiber which does not have any nap and damage yarns even in the subsequent carbonizing process by performing a uniform flame-resistant process on the thick acrylonitrile-based fiber bundle, the management thereof becomes more difficult. Thus, in the mechanical fill yarn inserting operation of the conventional art, it is difficult to realize a speed equal to or higher than the above-described speed.

Meanwhile, when the above-described precursor fiber fabric is obtained by the general weaving method in which the shuttle is beaten into the opening formed by the warp yarns so as to insert the fill yarn thereinto and the dent swings to the warp yarn so as to perform the beating for press-inserting the fill yarn to the cloth fell position, the warp yarn and the fill yarn scrape each other due to the beating, and hence there is a possibility that a damage may occur in the precursor fiber bundle which needs to be subjected to the delicate process even in the subsequent carbonizing process. For this reason, in this kind of fabric, the beating is not performed. Then, the fill yarn is inserted into the warp yarn in a zigzag shape at a predetermined pitch as illustrated in Patent Literatures 3 and 4 by adjusting the warp yarn transfer speed.

At this time, for example, when the precursor fiber fabric is produced by the general gripping rapier loom in a manner such that the beating is not performed inside the opening formed by the warp yarns with thick fiber fineness as plural long fiber bundles and the front end of the fill yarn is delivered at the center in the weaving width from one gripper provided at the front end of the pair of rapiers inserted into the opening from the left and right sides of the loom to the other gripper and these operations are repeated, there is a need to reliably perform the delivery of the front end of the fill yarn while paying more attention compared to the conventional method. Further, when the respective front ends of two left and right fill yarns are gripped and conveyed by the front end of the tube as in the tubular rapier loom disclosed in Patent Literature 4, more mistakes may occur compared to the gripper having a mechanical structure in the general gripping rapier loom, and hence it becomes more difficult to deliver the fill yarn between the pair of tubular rapiers.

The invention is made to solve the above-described problems, and it is an object of the invention to provide a loom capable of realizing an increase in warp yarn conveying speed compared to the conventional art, reliably separating respective warp yarns, for example, when weaving a precursor fiber fabric for a carbon fiber formed by a fiber bundle having a thick fiber fineness as a warp yarn, and realizing an increase in fill yarn inserting speed without raising a nap in a precursor fiber forming a fiber bundle and to provide a weaving method using the loom.

Means for Solving Problem

Such an object is effectively attained by the first basic configuration of the invention as a loom including: first and second fill yarn holding and conveying rods which are disposed at the left and right sides of an opening formed by plural warp yarns aligned while running at a predetermined speed in one direction and are repeatedly inserted into and separated from the opening toward the center of the weaving width in a synchronized state; a single fill yarn conveyor which is selectively gripped by opposite ends of the first or second fill yarn holding and conveying rod and is alternately held and conveyed by the first or second fill yarn holding and conveying rod; first and second rod operating units which cause the first and second fill yarn holding and conveying rods to be inserted into the opening in a synchronized state and to be withdrawn from the opening to the outside; and first and second fill yarn conveyor gripping and releasing units which are fixed to the opposite ends of the first and second fill yarn holding and conveying rods and alternately repeat operations of gripping, releasing, and delivering the fill yarn conveyor.

Further, the above-described object is attained by a weaving method having the following basic configuration and using the loom, and hence a high-quality fabric may be obtained with high productivity.

That is, there is provided a method of weaving a fabric including: inserting the first fill yarn holding and conveying rod into the opening toward the center in the weaving width inside the opening when the fill yarn conveyor is gripped by the gripping and releasing unit of the first fill yarn holding and conveying rod; inserting the second fill yarn holding and conveying rod into the opening toward the center in the weaving width inside the opening along with the inserting of the first fill yarn holding and conveying rod; delivering the fill yarn conveyor gripped by the first fill yarn holding and conveying rod at the center in the weaving width inside the opening to the gripping and releasing unit of the second fill yarn holding and conveying rod; and separating the first and second fill yarn holding and conveying rods to the outside of the opening after the delivery ends.

According to the preferred embodiment of the loom, each of the first and second rod operating units may include a linear motor and the first and second fill yarn holding and conveying rods may be operated by the linear motors. Further, the first and second gripping and releasing units may include first or second electromagnetic grip or first or second air chuck. The operations of gripping and releasing the fill yarn conveyor by the first or second electromagnetic grip or the first or second air chuck may be alternately performed at the center in the weaving width. Further, the fill yarn conveyor may include a bobbin holding frame which grips a fill yarn bobbin so that a fill yarn is unwound therefrom and first and second subject gripping and releasing portions which are provided in the bobbin holding frame so that the first and second fill yarn holding and conveying rods are alternately gripped and released by the first and second gripping and releasing units.

Further, preferably, the bobbin holding frame includes a drawing port through which the fill yarn unwound from the fill yarn bobbin is drawn to the outside of the frame and integrally includes a cylindrical member that horizontally protrudes to the outside of the frame by sharing the drawing port at the same plane as that of the bobbin holding frame. Then, the first and second fill yarn holding and conveying rods may include a confirmation unit which confirms whether the operation of delivering the fill yarn conveyor is reliably performed. The confirmation unit may include a piezoelectric member that confirms the operation of gripping the fill yarn conveyor by the first or second electromagnetic grip or the first or second air chuck, and a central control unit may receive an electric signal from the piezoelectric member and causes coil current of the second or first electromagnetic grip or air pressure of the first or second air chuck to be disappeared. In the representative embodiment of the warp yarn and the fill yarn, the warp yarn may be formed as a precursor fiber bundle of a carbon fiber, the fill yarn may be formed as a carbon fiber bundle, and the average conveying speed of the fill yarn conveyor may be 10 to 40 m/minute. From the viewpoint of improving the productivity, 15 m/minute is more desirable. Then, from the viewpoint of delivering the fill yarn conveyor, 30 m/minute is more desirable.

Effect of the Invention

According to the most characteristic configuration of the device of the invention, for example, when the linear motor is used in the rod operating unit as described above, the fill yarn may be inserted at the speed four times the case of the servo motor capable of increasing the speed twenty times the speed of the mechanical driving such as gear driving or hydraulic driving. Further, the fill yarn may be inserted without substantially generating the impact sound in addition to the silent driving sound of the linear motor since the operation of delivering the fill yarn conveyor is performed in a manner such that the fill yarn conveyor is delivered by using the magnetic force generated by alternately repeating the excitation and the demagnetization of the electromagnetic coils respectively provided in the gripping and releasing units of the front end of the rod. As a result, any problem caused by noise does not occur. As described above, since the precursor fabric is woven by using the warp yarn as the precursor fiber bundle and the fill yarn as the carbon fiber bundle, the tangling or the lapping between the warp yarns is prevented. Further, the flame-resistant step and the carbonizing step to be performed later may be reliably and continuously performed at a high speed in accordance with an increase in the fill yarn inserting speed. Furthermore, it is possible to obtain the high-quality carbon fiber which is not non-uniformly processed and has a small amount of raised naps without the influence of the fast speed.

Furthermore, the specific operation corresponding to the above-described embodiment will be proved by the description of the embodiment below.

BRIEF DESCRIPTION OF DRAWINGS

FIG. 5 is a diagram illustrating a gripping state of the fill yarn conveyor by a first gripping and releasing unit of the fill yarn inserting device.

FIG. 6 is an enlarged perspective view illustrating a second gripping and releasing unit and the fill yarn conveyor in an open state by the second gripping and releasing unit of the fill yarn inserting device.

BEST MODE(S) FOR CARRYING OUT THE INVENTION

Figure 1:
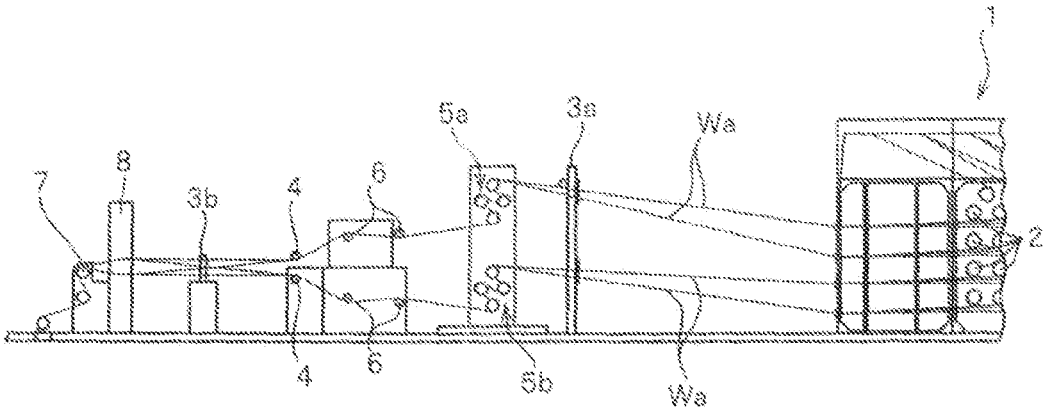
FIG. 1 is a process diagram illustrating an outline of a weaving process of the invention.

Hereinafter, a representative embodiment of the invention will be described in detail by referring to the drawings.

FIG. 1 illustrates a schematic configuration illustrating an entire loom according to the invention. In the description below, the characteristic configuration of the loom according to the invention will be described in detail, but the specific description of the configuration and the mechanism of the related art will not be repeated.

In FIG. 1, Reference Numeral 1 indicates a creel stand, and the creel stand 1 supports plural cones 2 around which warp yarns are wound so that the cones may be sent transversely. Reference Numeral 3*a* indicates a first dent stand which guides plural warp yarns Wa sent from the creel stand 1 so as to be aligned and separated, and the warp yarns Wa separated by the first dent stand 3*a* may be divided into two upper and lower groups while being guided to an upper guide roll group 5*a* and a lower guide roll group 5*b*. The upper and lower warp yarns Wa which are divided into the upper and lower groups through the upper and lower guide roll groups 5*a* and 5*b* are respectively guided through plural guides 6, 6, . . . 6, and finally pass through final guides 4 and 4 disposed at the upper and lower positions with a predetermined gap therebetween in the vertical direction so as to be introduced into a second dent stand 3*b*.

A heddle stand 8 is disposed between the second dent stand 3*b* and a cloth fell roll 7. The plural upper and lower warp yarns Wa which are separately arranged according to the weave texture through the second dent stand 3*b* subsequently pass through mails of a predetermined number of heddles (not illustrated) arranged in the same way according to the weave texture in the heddle stand 8. When the heddle 8*a* moves up and down based on the weave texture, plural warp yarns Wa intersect one another in the weaving width direction so as to form an opening (not illustrated) into which the fill yarn is inserted. In order to insert the fill yarn into the opening, a fill yarn inserting device (not illustrated) as the most characteristic constituent of the invention is disposed at left and right portions near the heddle stand 8 at the cloth fell side of the heddle stand 8.

According to the embodiment, since the beating by the dent is not performed, the reed for the beating is not provided. For this reason, in the embodiment, the cloth fell roll 7 is not intermittently driven, but is continuously driven so as to match the warp yarn supply speed. However, in a case where the beating is performed as in the normal case, the reed for the beating is provided, and the cloth fell roll 7 may be also driven intermittently so as to match the beating timing.

Next, a loom and a weaving method for a fiber fabric of a precursor of a carbon fiber as a representative embodiment of the fill yarn inserting device constituting a characteristic constituent of the invention in the loom with the above-described configuration will be described in detail by referring to the drawings. Furthermore, in the description below, the configurations of the respective constituents of the loom and the dimensions of the respective constituents will be specifically described, but these dimensions and the like are also the dimensions of the embodiments. Of course, the dimensions are not limited by these values.

Figure 2A:
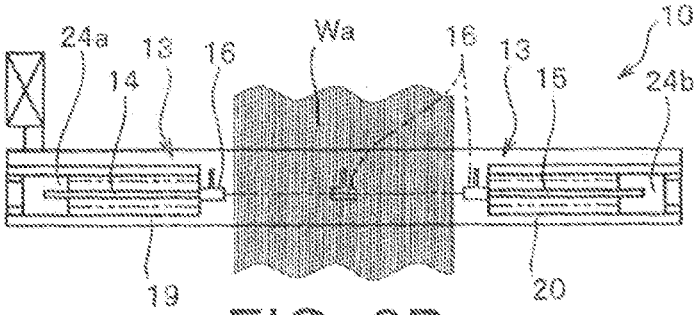
FIG. 2 is a schematic diagram roughly illustrating a plan view, a front view, and a side view of a fill yarn inserting device of the invention.
Figure 2C:
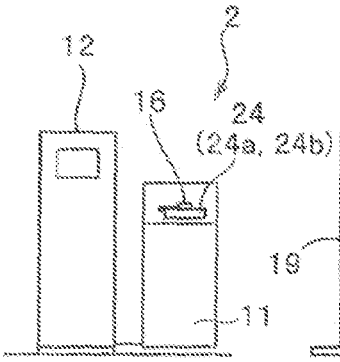
Figure 2B:
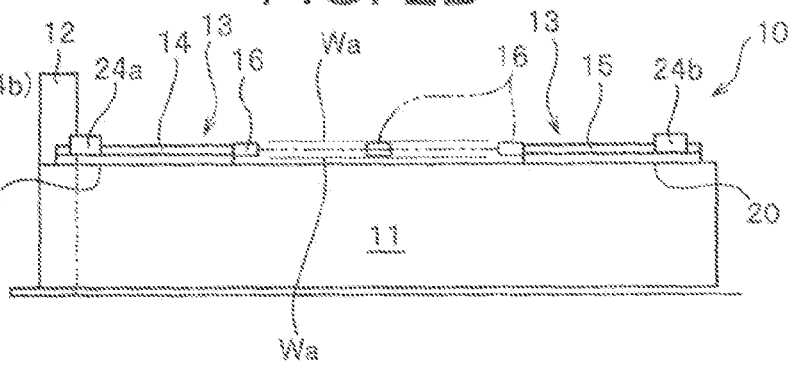
Figure 3:
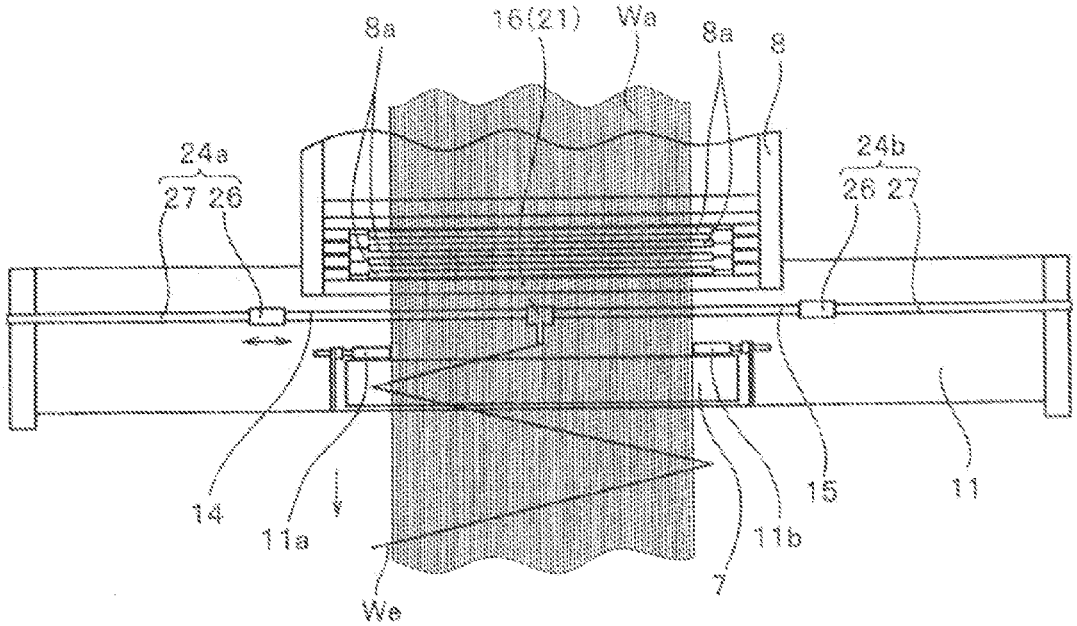
FIG. 3 is an enlarged plan view illustrating a main part of the fill yarn inserting device according to a representative embodiment.

FIG. 2 roughly illustrates a schematic configuration of a fill yarn inserting device 10 of the embodiment. FIG. 2A is a plan view illustrating a testing machine of the same device, FIG. 2B is a side view of the same device, and FIG. 2C is a front view of the same device. FIG. 3 is an enlarged plan view illustrating a main part of an actual device.

The fill yarn inserting device 10 of the embodiment is disposed near the downstream side of the heddle stand 8 in the warp yarn running direction. A base 11 which has a length substantially three times the weaving width is provided in the weaving width direction (the left and right direction of FIGS. 2A and 3), and plural warp yarns Wa as a precursor fiber bundle aligned in a sheet shape through the mails of four heddles 8*a* of the heddle stand 8 run toward the cloth fell roll 7 at a constant speed in the center portion of the upper surface of the base 11. A control panel 12 is provided near the left end of the base 11. The left and right upper surfaces of the base 11 with the sheet-like warp yarn Wa interposed therebetween are provided with fill yarn inserting units 13 and 13 as the most characteristic constituents of the invention. In the embodiment, the sheet width of the sheet-like warp yarn Wa is set as 2000 mm. The regulation of the sheet width is performed by sheet width regulating rolls 11*a* and 11*b* (see FIG. 3) which are provided at the left and right upper surfaces of the base 11 on the downstream side of the fill yarn inserting unit 13 in the warp yarn running direction.

As illustrated in FIGS. 2A to 2C, the pair of left and right fill yarn inserting units 13 and 13 disposed on the upper surface of the base 11 are disposed at the left and right sides of the opening formed by the plural warp yarns Wa running at a predetermined speed while being aligned in the same direction, are inserted into the opening toward the center in the weaving width, and are separated from the opening. The pair of left and right fill yarn inserting units includes a pair of left and right first and second fill yarn holding and conveying rods 14 and 15 which corresponds to a rapier of a rapier loom and repeats the inserting and separating operation in a synchronized state at this time, first and second gripping and releasing units 17 and 18 which are integrally fixed to the opposite ends of the first and second fill yarn holding and conveying rods 14 and 15 and alternately grip and open a single fill yarn conveyor 16 at the center of the weaving width, and first and second rod operating units 19 and 20 which support the respective base ends of the pair of first and second fill yarn holding and conveying rods 14 and 15 while being fixed thereto and are synchronously operated so as to be inserted the warp yarn opening and be separated therefrom. In addition, in the embodiment, the length of the base 11 in the loom width direction is 5000 mm, and the lengths of the first and second fill yarn holding and conveying rods 14 and 15 are 1000 mm.

Further, in the embodiment, first and second linear motors 24*a* and 24*b* which are used in a part of a preferred embodiment of the invention are used in the operating units 19 and 20 of the first and second fill yarn holding and conveying rods 14 and 15. Other than the linear motor, for example, a hydraulic cylinder, various gears, or a servo motor may be employed. However, for example, in a mechanical driving of the gear or the like, the driving speed is 0.2 m/second at best. Then, even in the servo motor capable of realizing the fast driving, the driving speed of 1 m/second may be realized at maximum. On the contrary, in the driving of the linear motor, the maximal driving speed may be set to 4 m/second. Further, a highly precise positioning control may be performed in the driving. Meanwhile, the present carbon fiber sintering speed is just 5 to 10 m/minute as described above, but in order to improve the productivity, the faster sintering speed is demanded. In this way, when the precursor fiber fabric weaving speed may be set to 4 m/second, the sintering speed may be also increased to 20 m/minute, and hence the step of producing the precursor fiber fabric, the flame-resistant step, and the carbonizing step may be continuously performed. Here, in a case where the above-described fast speed is not needed, a configuration may be employed in which the servo motor capable of performing a highly precise electronic control is used and the first or second fill yarn holding and conveying rod 14 or 15 is operated.

Figure 4:
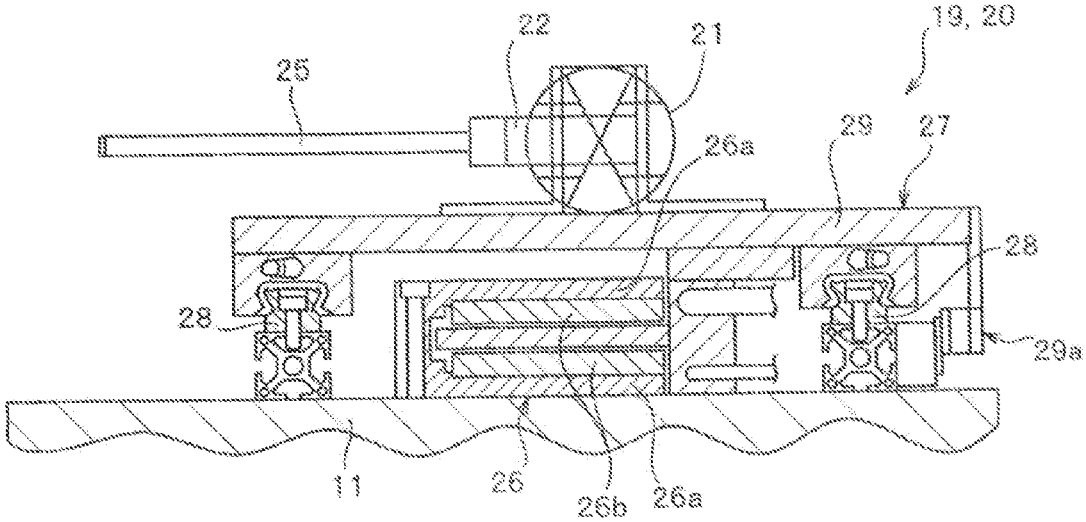
FIG. 4 is a cross-sectional view illustrating a configuration of an arrangement of a fill yarn conveyor and a linear motor constituting member according to the embodiment.

As schematically illustrated in FIG. 4, the driving structure using the linear motor 24 employed in the embodiment includes a linear motor stator 26 which is provided in a range of the operation lengths of the first and second fill yarn holding and conveying rods 14 and 15 on the upper surface of the base 11, a linear motor rotor 27 of which a part is disposed so as to be close to the upstream side surface of the linear motor stator 26 in the warp yarn running direction and a part extends to the inside of the linear motor stator 26, a linear guide 28 which is provided so as to extend in parallel to the linear motor stator 26 at the front and rear sides with the linear motor stator 26 and the linear motor rotor 27 interposed therebetween in the warp yarn running direction, and a plate-like movable base 29 which is disposed over the upper surfaces of the linear motor stator 26 and the linear motor rotor 27 and runs while being guided by the linear guide 28. A part of the movable base 29 is integrated with the linear motor rotor 27 through a magnetic body. Furthermore, Reference Numeral 29*a* in the same drawing indicates a linear scale.

As illustrated in FIG. 4, the linear motor stator 26 includes a stator body 26*a* of which the side surface at the upstream side of the warp yarn is opened and which is formed of a non-magnetic material such as a heat-resistant rigid synthetic resin or austenite-based stainless steel and has an elongated rectangular cross-section and plural electromagnetic coils 26*b* which are disposed in the loom width direction within the movement range of the movable base 29 along the lower inner wall surface. One linear motor rotor 27 and the movable base 29 are formed of the same magnetic material, and in the embodiment, steel is used.

The fill yarn conveyor 16 is formed as a bobbin holding frame 22 which supports a bobbin (fill yarn bobbin) 21 so as to be rotatable about its axis. As illustrated in FIGS. 5 and 6, the bobbin holding frame 22 includes a U-shaped body 22*a* including two first and second opening frames 22*a*-1 and 22*a*-2 which have opening ends and are disposed in parallel and a closing frame 22*a*-3 which is provided between the closed ends opposite to the opened end of the first opening frame 22*a*-1. The opening ends of the first and second opening frames 22*a*-1 and 22*a*-2 are provided with first and second subject gripping and releasing portions 30 and 31 which protrude outward in parallel to the closing frame 22*a*-3. The first and second subject gripping and releasing portions 30 and 31 are alternately gripped and released by the first and second gripping and releasing units 17 and 18 which are fixed to the front ends of the first and second fill yarn holding and conveying rods 14 and 15 at the center in the weaving width of the warp yarn opening.

Further, a fill yarn drawing hole is formed at the center of the closing frame 22*a*-3. Further, a fill yarn drawing tube 25 is formed at the center of the closing frame 22*a*-3 so as to extend outward in parallel to the first and second opening frames 22*a*-1 and 22*a*-2. The inner space of the fill yarn drawing tube 25 communicates with the fill yarn drawing hole, and the fill yarn We which is unwound from the fill yarn bobbin 21 held by the bobbin holding frame 22 is delivered to the outside while passing through the inside of the fill yarn drawing hole and the fill yarn drawing tube 25. As illustrated in the enlarged view of in FIG. 6, the first and second subject gripping and releasing portions 30 and 31 are formed by iron blocks 30*a* and 31*a* which are formed in a head-cut truncated shape, and the peripheral surfaces thereof are enclosed by synthetic resinous covers 30*b* and 31*b*. This configuration is effective although the leakage flux is slightly reduced. Further, a pin is fixed to the first and second subject gripping and releasing portions 30 and 31 formed in a head-cut truncated shape while penetrating the first and second subject gripping and releasing portions in the radial direction, and both ends thereof protrude outward as guide pins 30*c* and 31*c* from the peripheral surface thereof.

FIG. 5 illustrates the fill yarn conveyor 16 and the first gripping and releasing unit 17 according to the embodiment, and FIG. 6 is an enlarged perspective view thereof. Since the second gripping and releasing unit 18 has a shape and a structure which are bilaterally symmetrical to those of the first gripping and releasing unit 17, the second gripping and releasing unit 18 is not illustrated in FIG. 5 in the description below, and the description thereof is also not repeated. The first gripping and releasing unit 17 constitutes an electromagnetic grip of the invention, and alternately performs the gripping and the releasing of the fill yarn conveyor 16. The first fill yarn holding and conveying rod 14 is formed as a square columnar member having a rectangular cross-section. Then, as illustrated in FIG. 5, the first gripping and releasing unit 17 fixed to the free end forms first and second chambers 17*a* and 17*b* which are formed by cutting two substantially cubic members so that both members communicate with each other.

As illustrated in FIG. 5, the free end surface of the first room 17*a* is opened, and the opening surface has the shape and the dimension of the bottom surface of the first subject gripping and subject releasing unit 30. Then, the opening end surface extends toward the second room 17*b* while the diameter thereof gradually decreases so as to form the first room 17*a* with a truncated conical shape, and is connected to the second room 17*b* with a columnar shape. In the example illustrated in the drawing, the diameter of the second room 17*b* is equal to the diameter of the diameter of the upper bottom surface of the first room 17*a*. The inner shape of the first room 17*a* with a truncated conical shape just has a shape and a dimension in which the entire first subject gripping and subject releasing unit 30 with a head-cut truncated shape is fitted in an abutting state. Meanwhile, an electromagnetic coil 17*c* as an electromagnetic grip of the invention is stored and fixed inside the second room 17*b* with a columnar shape, and is excited and demagnetized by receiving an exciting signal and a demagnetizing signal sent from the control panel 12. Furthermore, the opening end of the first room 17*a* is provided with a pair of pin guide grooves 17*h* and 17*h* which guides the pair of guide pins 30*c* and 30*c* protruding from the peripheral surface of the first subject gripping and subject releasing unit 30.

Furthermore, in the example illustrated in the drawing, the electromagnetic grip is employed as the first and second gripping and releasing units 17 and 18 which grip and release the fill yarn conveyor 16, but an air chuck may be used instead of the electromagnetic grip. In this case, the introduction and the discharge of the air pressure are alternately performed by the air supply and discharge signal sent from the control panel 12.

In addition, in the embodiment, as illustrated in FIG. 5, the dimensions of the respective portions of the bobbin holding frame 22 are set such that the thickness of the U-shaped body 22*a* is 38 mm, the dimension between the outer surfaces of two first and second opening frames 22*a*-1 and 22*a*-2 is 187 mm, the dimension between the outer surface of the closing frame 22*a*-3 and the front end surface of the first opening frame 22*a*-1 is 67 mm, and the protruding length of the fill yarn drawing tube 25 protruding from the bobbin holding frame 22 is 116 mm. Further, the dimension from the opening end of the bobbin holding frame 22 to the front end of the fill yarn drawing tube 25 is 180 mm, and the dimension from the bobbin support center to the front end of the fill yarn drawing tube 25 is 170 mm. The bobbin holding frame 22 with the configuration and the dimension moves inside the opening of the warp yarn Wa in the weaving width direction in a reciprocating manner by directing the front end of the fill yarn drawing tube 25 toward the cloth fell position. The weight of the bobbin holding frame 22 is 1 kg, and the weight of the bobbin is 3 to 4 kg.

In the embodiment, since the protruding length of the fill yarn drawing tube 25 from the bobbin support center is set to be long, the fill yarn We which is unwound from the bobbin 21 may move close to the cloth fell roll 7 (FIG. 1) through the fill yarn drawing tube 25 when the bobbin holding frame 22 runs inside the opening of the warp yarn Wa so as to insert the fill yarn. As a result, even when the bobbin holding frame 22 is increased in size compared to the shuttle or the fill yarn gripper of the conventional art, the fill yarn inserting density may be increased. Further, as described above, in order to strongly grip the bobbin holding frame 22 having a bobbin and a large weight, the suction force of the electromagnetic coil 17*c* is set to 30 kg at maximum in the embodiment.

The opening ends of the first and second opening frame 22*a*-1 and 22*a*-2 are provided with the first and second subject gripping and releasing portions 30 and 31 which protrude outward in parallel to the closing frame 22*a*-3. In the first and second subject gripping and releasing portions 30 and 31, the fill yarn conveyor 16 is delivered by alternately and repeatedly gripping and releasing the fill yarn conveyor 16 using the first and second gripping and releasing units 17 and 18 fixed to the front ends of the first and second fill yarn holding and conveying rods 14 and 15 at the center of the weaving width inside the warp yarn opening.

Further, in the embodiment, passage confirming units 17*d* and 18*d* that confirm the operation of reliably passing the fill yarn conveyor 16 are integrally attached to the side surfaces of the first and second gripping and releasing units 17 and 18 fixed to the front ends of the first and second fill yarn holding and conveying rods 14 and 15. When the control panel 12 receives electric or magnetic passage signals from the passage confirming units 17*d* and 18*d*, the input and the interruption of the current to the electromagnetic coil 17*c* which is accommodated and fixed to the second rooms 17*b* and 18*b* of the first and second gripping and releasing units 17 and 18 are automatically performed. For example, in a state where the first gripping and releasing unit 17 grips the fill yarn conveyor 16 and the second gripping and releasing unit 18 does not grip the fill yarn conveyor 16 in an empty state, the first and second linear motors 24*a* and 24*b* are driven in a synchronized state so that the first and second fill yarn holding and conveying rods 14 and 15 are inserted and moved in a direction in which the inside of the opening of the warp yarn Wa approaches the center in the weaving width from the left and right ends of the base 11. At this time, current is supplied to the electromagnetic coil 17*c* of the first gripping and releasing unit 17, and current is not supplied to the electromagnetic coil (not illustrated) of the second gripping and releasing unit 18. Then, the first subject gripping and subject releasing unit 30 is suctioned to the first room 17*a* of the first gripping and releasing unit 17 by the magnetic force generated by the electromagnetic coil 17*c* of the first gripping and releasing unit 17.

As the confirmation unit 17*d* of the first gripping and releasing unit 17, the confirmation unit 18*d* is provided at the outer surface of the second gripping and releasing unit 18 so as to confirm the existence of the first gripping and releasing unit 17 when the first and second fill yarn holding and conveying rods 14 and 15 move in a direction in which both rods approach each other so that the first gripping and releasing unit 17 of the fill yarn conveyor 16 at the center in the weaving width inside the opening approaches the second gripping and releasing unit 18 fixed to the front end of the second fill yarn holding and conveying rod 15 or the guide pins 30*c* and 31*c* provided in the first gripping and releasing unit 17 are fitted to the pair of pin guide grooves 18*h* (not illustrated) formed in the second gripping and releasing unit 18. As the confirmation units 17*d* and 18*d*, a piezoelectric element or a proximity switch may be exemplified. Electric signals from the confirmation units 17*d* and 18*d* are sent to a driving source (not illustrated) of the electromagnetic coil 17*c* through a central control unit inside the control panel 12 so as to interrupt the coil current of the electromagnetic coil 17*c* and input the driving power to the counter electromagnetic coil (not illustrated) so that current flows to the electromagnetic coil.

Next, the weaving method using the loom according to the embodiment with the above-described configuration will be described in detail by referring to the drawings.

In FIG. 1, the warp yarns Wa as the precursor fiber bundle of various acrylonitrile-based fibers are transversely sent from plural cones 2 of the creel stand 1, and are introduced into the first dent stand 3*a*. In the first dent stand 3*a*, various warp yarns Wa are divided into two upper and lower groups. Then, the warp yarns Wa of the respective groups pass through the dent (not illustrated) one by one, are guided by the upper guide roll group 5*a* and the lower guide roll group 5*b* so as to be aligned in parallel, pass through plural guides 6, 6, . . . , and finally pass through the final guides 4 and 4 disposed at the upper and lower positions with a predetermined vertical gap therebetween so as to be sent to the second dent stand 3*b*. The sheet-like warp yarns Wa which are separately sent to the upper and lower sides by the second dent stand 3*b* pass through the dent of the second dent stand 3*b* one by one, are divided at the desired interval, are inserted into the mails of the heddle 8*a* of the heddle stand 8 according to the weave texture, and are sent to the cloth fell roll 7. The running speed of the warp yarn Wa at this time is defined by the fill yarn insertion speed of the fill yarn We and the fill yarn density. In the embodiment, the fabric is the plain weave texture, and the fill yarn insertion opening is formed between the cloth fell roll 7 and the final guides 4 and 4 by alternately moving four heddles 8*a* arranged in parallel and illustrated in FIG. 3 up and down through a heddle operating source (not illustrated).

Here, in the embodiment, the acrylonitrile-based fiber subjected to the general process after the fiber spinning is used in the warp yarn Wa, and the number of filaments of one precursor fiber bundle is 50 K (50000), and the carbon fiber bundle of which the number of filaments is 1 K (1000) is used in the fill yarn We. The reason why the carbon fiber is used in the fill yarn We is because various problems occurring when performing a flame-resistant process on the precursor fabric subjected to the weaving may be prevented. Specifically, if the fiber bundle which is formed of the same material as that of the warp yarn Wa is used as the fill yarn We, when performing the flame-resistant process on the precursor fiber, the fiber thickness increases at the intersection portion between the fill yarn We and the warp yarn Wa as the precursor fiber bundle, the heat storage amount of the intersection portion becomes larger than the heat storage amounts of the other portions, and the heat transfer speed at the intersection portion becomes slow. For this reason, the uniform flame-resistant process may not be easily performed between the surface side constituting fiber and the inner side constituting fiber of the intersection portion. As a result, this non-uniform flame-resistant process also affects the subsequent carbonizing process, and hence the non-uniform process is performed on the carbon fiber as the finished product in many cases. Thus, the high-quality product may not be easily obtained. In order to perform the uniform process by preventing the non-uniform flame-resistant process, the carbon fiber bundle which is carbonized in advance is used in the fill yarn We in the embodiment.

The plural upper and lower warp yarns Wa which are separately arranged according to the weave texture through the second dent stand 3*b* subsequently pass through the mails of a predetermined number of heddles (not illustrated) arranged according to the weave texture in the heddle stand 8. When four heddles 8*a* move up and down according to the weave texture, the plural warp yarns Wa intersect one another in the weaving width direction so as to form an opening into which the fill yarn (not illustrated) is inserted. In order to insert the fill yarn into the opening, a fill yarn inserting device (not illustrated) as the most characteristic constituent of the invention is disposed at the left and right portions near the heddle stand 8 on the cloth fell side of the heddle stand 8.

According to the embodiment, since the beating by the dent is not performed, the reed for the beating is not provided. For this reason, in the embodiment, the cloth fell roll 7 is not intermittently driven, but is continuously driven so as to match the warp yarn supply speed. However, in a case where the beating is performed as in the normal case, the reed for the beating is provided, and the cloth fell roll 7 may be also driven intermittently so as to match the beating timing.

While the openings are alternately formed, the linear motor 24 and the electromagnetic coil 17*c* are driven while being controlled by various signals sent from the central control unit provided in the control panel 12. In FIGS. 2A and 2B, the fill yarn conveyor 16 is gripped and fixed by the first gripping and releasing unit 17 of the first fill yarn holding and conveying rod 14 operated by the driving of the first linear motor 24*a* disposed at the left side, and the second fill yarn holding and conveying rod 15 operated by the driving of the second linear motor 24*b* disposed at the right side stays at the standby position without gripping the fill yarn conveyor 16. Accordingly, in this state, current flows to the electromagnetic coil 17*c* of the first gripping and releasing unit 17, but current does not flow to the electromagnetic coil (not illustrated) of the second gripping and releasing unit 18. The magnetic force generated when current flows to the electromagnetic coil 17*c* at this time has an ability of adsorbing and gripping the weight of 30 kg as described above. For this reason, even the fill yarn conveyor 16, in which the total weight including the bobbin weight of the fill yarn We is 4 to 5 kg, may be reliably gripped and fixed with the high gripping force. Due to the highly precise electromagnetic switching control of the electromagnetic coil 17*c*, it is possible to prevent an accident in which the fill yarn conveyor 16 falls during the passage operation.

Now, the warp yarns Wa start to run, and four heddles 8*a* alternately move up and down according to the weave texture. In the embodiment, various warp yarns Wa are separated into two upper and lower groups as described above, the warp yarns Wa of one group sent from the upper side pass through one mail of one plated heddle 8*a*, and the warp yarn Wa of one group sent from the lower side passes through the other mail. Then, in this state, the respective heddles 8*a* are alternately moved up and down at every other position.

When the initial opening is formed, the first and second linear motors 24*a* and 24*b* are driven in a direction in which both motors approach each other, so that the first and second fill yarn holding and conveying rods 14 and 15 are inserted into the opening. At this time, the fill yarn We is unwound from the bobbin 21 with the movement of the fill yarn conveyor 16 gripped by the first gripping and releasing unit 17 of the second fill yarn holding and conveying rod 14, and is drawn from the front end of the fill yarn drawing tube 25 of the bobbin holding frame 22 so that the fill yarn We is extracted toward the center in the weaving width inside the opening. Here, when the first and second gripping and releasing units 17 and 18 of the first and second fill yarn holding and conveying rods 14 and 15 approach the center in the weaving width, for example, the pair of guide pins 31*c* and 31*c* protruding from the second subject gripping and subject releasing unit 31 of the bobbin holding frame 22 approach the pair of pin guide grooves 18*h* and 18*h* of the second gripping and releasing unit 18 of the second fill yarn holding and conveying rod 15, the approaching with respect to the pin guide grooves 18*h* and 18*h* is detected by a proximity switch. Then, when the guide pins 31*c* and 31*c* are fitted to the pin guide grooves 18*h* and 18*h*, the contact pressure is detected by a piezoelectric element. Accordingly, an electric signal is transmitted to the central control unit, so that the current of the electromagnetic coil 17*c* is interrupted and the current flows to the electromagnetic coil (not illustrated) of the second gripping and releasing unit 18. As a result, the gripping of the fill yarn conveyor 16 by the first gripping and releasing unit 17 is released, and the fill yarn conveyor 16 is gripped and fixed by the second gripping and releasing unit 18. Then, the delivery of the fill yarn conveyor 16 ends.

When the delivery ends, the driving of the first and second linear motors 24*a* and 24*b* is reversely performed, so that the first and second fill yarn holding and conveying rods 14 and 15 pass through the same opening so as to return to the original standby position outside the opening. During the returning operation, the fill yarn We is continuously unwound from the bobbin 21 delivered from the first fill yarn holding and conveying rod 14 to the second fill yarn holding and conveying rod 15, and is drawn out from the front end of the fill yarn drawing tube 25 of the bobbin holding frame 22. Then, the fill yarn We is directed toward the weaving width end outside the opening, so that the remaining half of the fill yarn outside the opening is inserted. When the first and second fill yarn holding and conveying rods 14 and 15 are returned to the standby position while the second fill yarn holding and conveying rod 15 grips the fill yarn conveyor 16, the heddle 8*a* at one position moves downward and the heddle 8*a* at the other position moves upward, so that a new opening is formed by the inversing of the intersection of the warp yarns Wa. When the opening is formed, the driving of the first and second linear motors 24*a* and 24*b* in the fill yarn inserting direction starts, so that the first and second fill yarn holding and conveying rods 14 and 15 are inserted to the center in the weaving width direction inside the opening.

Figure 7:
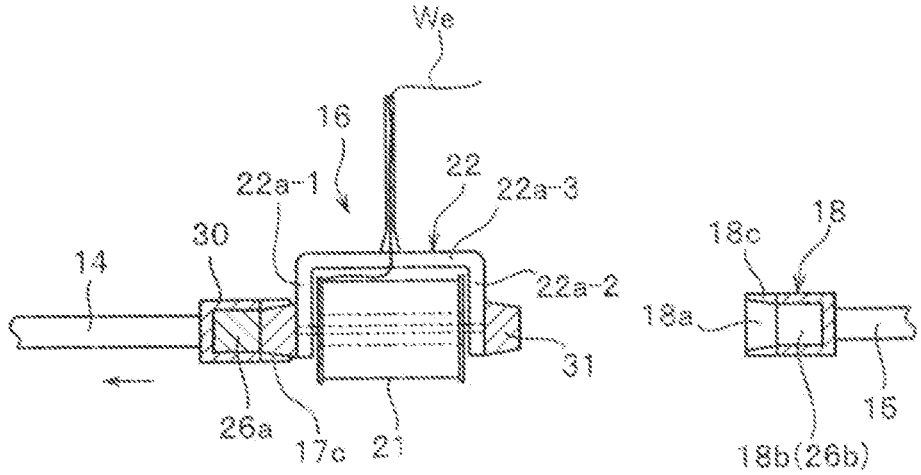
FIG. 7 is a partially front view illustrating a running state of first and second fill yarn holding and conveying rods after the fill yarn conveyor is delivered from the second gripping and releasing unit to the first gripping and releasing unit.

At this time, the fill yarn conveyor 16 is continuously gripped by the second fill yarn gripping and releasing unit 18 fixed to the second fill yarn holding and conveying rod 15. For this reason, the fill yarn We of the right half of FIG. 1 is inserted until the second fill yarn holding and conveying rod 15 moves toward the center in the weaving width inside the opening. When the fill yarn conveyor 16 reaches the center in the weaving width inside the opening, the first fill yarn gripping and releasing unit 17 fixed to the front end of the first fill yarn holding and conveying rod 14 moving toward the center in the weaving width inside the opening also reaches the center in the weaving width, the supply of the current to the electromagnetic coil (not illustrated) of the second fill yarn gripping and releasing unit 18 is stopped, and the supply of the current to the electromagnetic coil 17*c* of the first fill yarn gripping and releasing unit 17 is started. Then, due to the magnetic force of the electromagnetic coil 17*c*, the fill yarn conveyor 16 is delivered from the second fill yarn gripping and releasing unit 18 to the first fill yarn gripping and releasing unit 17. Here, the driving of the first and second linear motors 24*a* and 24*b* is switched to the reverse direction, and the first and second fill yarn holding and conveying rods 14 and 15 are made to run in the separating direction as illustrated in FIG. 7, so that the first and second fill yarn holding and conveying rods return to the standby position outside the opening. In the meantime, the fill yarn We is conveyed by the fill yarn conveyor 16, and the fill yarn is inserted from the center in the weaving width into the opening of the left half of FIG. 1. By repeating the above-described operation, a desired fabric is woven.

Regarding the inserting speed of the fill yarn We of the invention, since the first and second linear motors 24*a* and 24*b* are used, the maximal running speed of the linear motor rotor 27 (movable base 29) is 4 m/second, and the maximal running speed may be four times the maximal speed of the servo motor capable of realizing a high speed compared to, for example, the mechanical driving such as gear driving or hydraulic driving. Further, since any impact sound is not substantially generated when delivering the fill yarn conveyor 16 in addition to the silent driving sound of the linear motor, any problem caused by noise does not occur. In this way, the flame-resistant step and the carbonizing step may be reliably performed at a high speed in accordance with an increase in the fill yarn inserting speed. Further, the high-quality carbon fiber may be obtained without the influence caused by an increase in the fill yarn inserting speed.

EXPLANATIONS OF LETTERS OR NUMERALS

1 creel stand
2 cone (warp yarn bobbin)
3*a* first dent stand
3*b* second dent stand
4 final guide
5*a* upper guide roll group
5*b* lower guide roll group
6 guide
7 cloth fell roll
8 heddle stand
8*a* heddle
10 fill yarn inserting device
11 base
11*a*, 11*b* sheet width regulating roll
12 control panel
14, 15 first and second fill yarn holding and conveying rods
16 fill yarn conveyor
17, 18 first and second gripping and releasing units
17*a* (18*a*) first yarn
17*b* (18*b*) second yarn
17*c* electromagnetic coil
17*d*, 18*d* confirmation unit (piezoelectric element, proximity switch)
17*h*, 18*h* pin guide groove
19, 20 first and second rod operating units
21 bobbin (fill yarn bobbin)
22 bobbin holding frame
22*a*-1, 22*a*-2 first and second opening frames
22*a*-3 closing frame
24 linear motor
24*a*, 24*b* first and second linear motors
25 fill yarn drawing tube
26 linear motor stator
26*a* stator body
26*b* electromagnetic coil
27 linear motor rotor
28 linear guide
29 movable base
29*a* linear scale
30, 31 first and second subject gripping portion and subject releasing portion
30*a*, 31*a* iron block
30*b*, 31*b* synthetic resinous cover
30*c*, 31*c* guide pin
Wa warp yarn
We fill yarn

The invention claimed is:

1. A loom, comprising:
a first and a second fill yearn holding and conveying rods;
a single fill yarn conveyor;
a first and a second rod operating units,
a first and a second linear motors, and
a first and a second fill yarn conveyor gripping and releasing units,
wherein
the first and second fill yarn holding and conveying rods are disposed at left and right sides of an opening formed by plural warp yarns aligned while running at a predetermined speed in one direction and are repeatedly inserted into and separated from the opening toward center of a weaving width in a synchronized state;
the single fill yarn conveyor is selectively gripped by opposite ends of the first or the second fill yarn holding and conveying rod and is alternately held and conveyed by the first or the second fill yarn holding and conveying rod;
the first and second rod operating units cause the first and the second fill yarn holding and conveying rods to be inserted into the opening in a synchronized state and to be withdrawn from the opening;
the first and second linear motors are in the first and second rod operating units, respectively, and operate the first and second fill yarn holding and conveying rods directly by reciprocating rectilineal motions; and
the first and second fill yarn conveyor gripping and releasing units are fixed to opposite ends of the first and the second fill yarn holding and conveying rods and alternately repeat operations of gripping, releasing, and delivering the fill yarn conveyor.

2. The loom according to claim 1,
wherein the first and the second gripping and releasing units comprise a first or a second electromagnetic grip, or a first or a second air chuck.

3. The loom according to claim 2,
wherein the operations of gripping and releasing the fill yarn conveyor by the first or the second electromagnetic grip, or the first or the second air chuck are alternately performed at the center in the weaving width.

4. The loom according to claim 1,
wherein the fill yarn conveyor comprises
a bobbin holding frame which grips a fill yarn bobbin so that a fill yarn is unwound therefrom, and
a first and a second subject gripping and releasing portions which are provided in the bobbin holding frame so that the first and the second fill yarn holding and conveying rods are alternately gripped and released by the first and second gripping and releasing units.

5. The loom according to claim 4,
wherein the bobbin holding frame comprises
a drawing port through which the fill yarn unwound from the fill yarn bobbin is drawn outside of the bobbin holding frame, and
a cylindrical member that horizontally protrudes outside of the bobbin holding frame by sharing the drawing port at the same plane as a plane of the bobbin holding frame.

6. The loom according to claim 1,
wherein the first and the second fill yarn holding and conveying rods comprise a confirmation unit which confirms whether the operation of delivering the fill yarn conveyor is reliably performed.

7. The loom according to claim 2, further comprising:
a piezoelectric member that confirms the operation of gripping the fill yarn conveyor by the first or the second electromagnetic grip, or the first or the second air chuck,
wherein a central control unit receives an electric signal from the piezoelectric member and causes coil current of the second or the first electromagnetic grip, or air pressure of the first or the second air chuck to disappear.

8. A method of weaving a precursor carbon fiber fabric with the loom according to claim 1, the method comprising:
employing a precursor fiber bundle of a carbon fiber as a warp yarn and employing a carbon fiber bundle as a fill yarn;
inserting the first fill yarn holding and conveying rod into the opening toward the center in the weaving width inside the opening when the fill yarn conveyor is gripped by the gripping and releasing unit of the first fill yarn holding and conveying rod;

inserting the second fill yarn holding and conveying rod into the opening toward the center in the weaving width inside the opening along with the inserting of the first fill yarn holding and conveying rod;

delivering the fill yarn conveyor gripped by the first fill yarn holding and conveying rod at the center in the weaving width inside the opening to the gripping and releasing unit of the second fill yarn holding and conveying rod; and separating the first and second fill yarn holding and conveying rods outside of the opening after said delivering.

9. The method according to claim 8, wherein an average conveying speed of the fill yarn conveyor is from 10 to 40 m/minute.

10. The method according to claim 9, wherein a total fiber fineness of the precursor fiber bundle of the carbon fiber is from 1,500 dTex to 600,000 dTex.

* * * * *